US010759042B1

(12) United States Patent
Wilson, III

(10) Patent No.: US 10,759,042 B1
(45) Date of Patent: Sep. 1, 2020

(54) MAGNETIC SOCKET STRAPS AND ACCESSORIES

(71) Applicant: Socket Straps LLC, Riverton, UT (US)

(72) Inventor: Richard Leroy Wilson, III, Riverton, UT (US)

( * ) Notice: Subject to any disclaimer, the term of this patent is extended or adjusted under 35 U.S.C. 154(b) by 0 days.

(21) Appl. No.: 16/539,979

(22) Filed: Aug. 13, 2019

(51) Int. Cl.
*B25H 3/00* (2006.01)
*A45F 5/02* (2006.01)
*A45F 5/00* (2006.01)

(52) U.S. Cl.
CPC ..... *B25H 3/003* (2013.01); *A45F 5/021* (2013.01); *A45F 2005/008* (2013.01); *A45F 2200/0575* (2013.01)

(58) Field of Classification Search
CPC ..... A45F 5/021; A45F 2005/008; A45F 2200/0575; A45F 2003/006; Y10S 206/818; Y10S 211/01; B25H 3/003
USPC ..... 224/183; 206/378, 350; 211/70.6, 211/DIG. 1
See application file for complete search history.

(56) References Cited

U.S. PATENT DOCUMENTS 5,544,747 A * 8/1996 Horn ..... B25H 3/04 206/350
5,743,394 A * 4/1998 Martin ..... B25H 3/003 206/350
6,643,845 B2 * 11/2003 O'Dea ..... A41D 19/01594 2/160
8,140,131 B1 * 3/2012 Green ..... H04B 1/385 368/10
8,967,437 B2 * 3/2015 Wilson ..... A45F 5/00 224/152
2010/0025442 A1 * 2/2010 Shurm ..... A45F 5/00 224/183
2013/0254976 A1 * 10/2013 Aravena ..... F41C 33/00 2/300

* cited by examiner

*Primary Examiner* — Nathan J Newhouse
*Assistant Examiner* — Matthew T Theis
(74) *Attorney, Agent, or Firm* — Intellectual Strategies

(57) ABSTRACT

A magnetic holder for sockets made of silicone rubber or similar material that has a series of cylindrical troughs of consistent diameter and a flat surface on the opposing plane. Between the cylindrical troughs and the opposing flat surface are a series of magnets embedded in the rubber. The magnets are position so that one pole is directed towards the cylindrical trough and the opposite pole is directed towards the flat surface. The flat surface can be attached to any ferrous material, while each of the magnets and cylindrical roughs will work together to hold a socket in place.

4 Claims, 4 Drawing Sheets

MAGNETIC SOCKET STRAPS AND ACCESSORIES

BACKGROUND OF THE INVENTION

1. Field of the Invention

The present invention relates to a portable socket holder and its accessories. The socket holder uses strong magnets (equivalent to N42 and stronger) embedded within a silicone, or other similar rubber-like material, to hold a subset of one's socket collection.

2. Description of the Prior Art

When using a socket wrench and sockets, most tasks only require a small subset of the total number of sockets contained within the socket set(s). This invention addresses this observation by limiting the carrying capacity to only a subset of the socket set(s), which subset can easily be exchanged when the user starts a different task. Further, current devices used to magnetically hold ferrous tools are missing one or more features that would improve the usefulness of such devices, especially when such devices are used specifically for sockets. One feature missing in all such current devices is construction from a material that can be secured to a painted car body without damaging the finish. Until recently, rubber over-molding required temperatures too high to be a practical solution. This invention leverages the latest technologies for low temperature curing of liquid silicon rubber, such as Silbione® LSR Select™. The following citations provide samples of how current inventions could be improved.

U.S. Pat. No. 6,530,508 relates to a magnetic utility wristband, but this wristband does not provide for adequately separating sockets from each other, which is necessary if the wristband has magnets strong enough to carry the weight of sockets.

U.S. patent application Ser. No. 15/999,828 relates to a magnetic holder constructed of rigid material, which could be harmful to painted surfaces. It also contains many cracks and crevices where grease, oil, and other materials could accumulate.

U.S. patent application Ser. No. 14/073,946 relates to a magnetic frame for storing sockets, but it is more suited for an entire socket set and not for a subset of sockets, thus limiting its portability. It also has a rigid construction that could be harmful to painted surfaces.

U.S. Pat. No. 4,591,817 is constructed from rigid material on the outside, which could be harmful to painted surfaces. Also, the magnetic material used for the inside construction does not provide sufficient force to adequately secure sockets in place.

U.S. Pat. No. 4,802,580 is yet another invention constructed from rigid material, which could be harmful to painted surfaces. The design also uses a barrier that limits visibility if the user of the invention is on the same side as the barrier.

U.S. Pat. No. 5,080,230 refers to a socket holding apparatus. The socket holders have pre-defined bores that limit the sizes and shapes of the sockets that can be used. The magnetic particles also do not provide enough strength to hold heavy sockets if the bore is not a perfect fit for the socket.

U.S. Pat. No. 5,313,181 refers to a magnetic socket holder with a bar magnet at the base of the sockets. When sockets are held in this manner, they come loose very easily; thus, this design is not suited for holding sockets upside-down, but is more suited for a horizontal surface.

U.S. Pat. No. 5,316,143 is designed to hold sockets within a toolbox or other horizontal surface. It is also made from rigid material and will hold between six and thirty-six sockets, which is more sockets than is needed for most tasks, especially automotive tasks.

U.S. Pat. No. 5,456,359 contains rigid sidewalls and base, which could be harmful to painted surfaces. It also features cylindrical troughs of increasing/decreasing diameters, which is not well suited for similarly sized sockets.

U.S. Pat. No. 5,544,747 features cylindrical troughs of increasing/decreasing diameters, which is not well suited for similarly sized sockets. The flexible magnetic strip referenced by certain embodiments would also not be strong enough to hold heavy sockets. This invention is also constructed from rigid material that could be harmful to painted surfaces.

U.S. Pat. No. 9,763,510 describes a vest used to magnetically hold tools. Such a device adds bulk to the user, which could be problematic when working in confined spaces. The design is also not well suited for heavy sockets, since no provisions are made for adequately separating sockets held in place by strong magnets.

BRIEF SUMMARY OF THE INVENTION

The main embodiment of this invention consists of a silicone rubber, or similar material, that has been molded in a strip with between two and nine partially cylindrical troughs used to hold sockets. Within the rubber are a number of strong magnets that are equal in number to the number of cylindrical troughs. Each magnet is suspended close to the surface of the base of trough and is strong enough to hold a socket securely in place while subjected to a large amount of jostling in a typical automotive service shop setting. Each tool is portable and will attach to any ferrous material close to the task being performed by the user. The rubber material is easy to clean and will not damage painted surfaces.

If desired, the socket holder can be attached to either a belt clip or a watch strap adapter to maximize the portability of the holder. Both the belt clip and watch strap adapter are also described within this document.

An additional embodiment of this invention is the integration of the socket holder and a wrist strap in a single, seamless wrist strap. The wrist strap would consist of two buckles used to secure the socket holder to the user's wrist. Two buckles are essential to reducing unwanted shifting of the socket holder while the user is working.

BRIEF DESCRIPTION OF THE SEVERAL VIEWS OF THE DRAWING(S)

A brief description of the drawings is as follows.

DETAILED DESCRIPTION OF THE INVENTION

Figure 1:
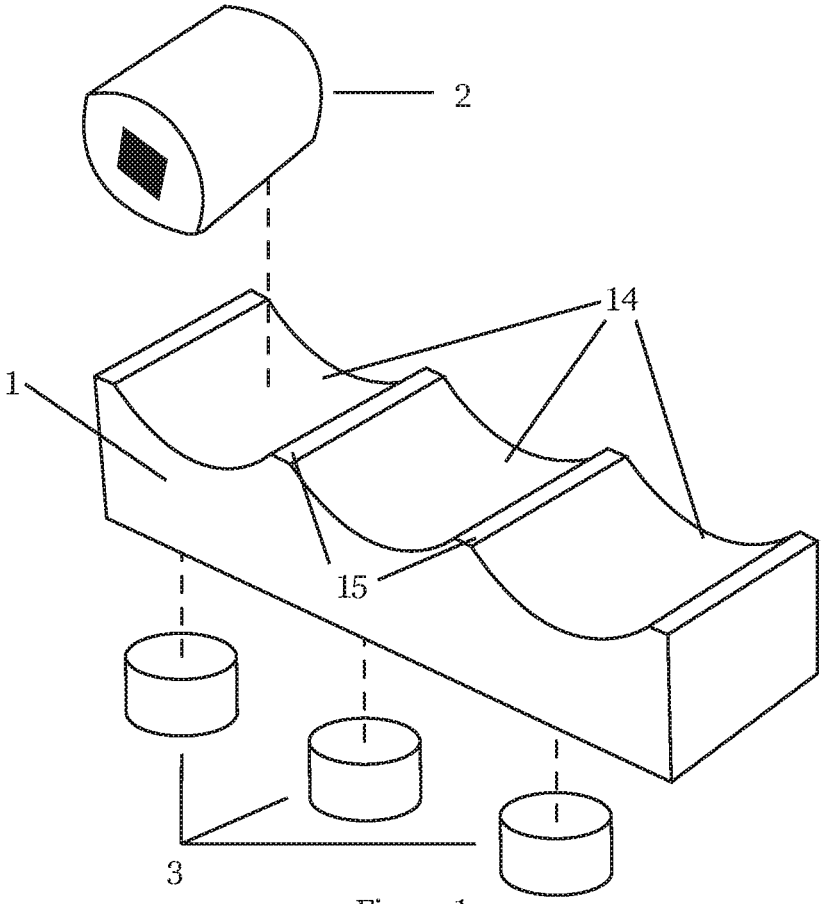
FIG. 1 shows the main embodiment of the invention, consisting of multiple strong magnets encased within a silicone rubber (or other similar material) body.

In FIG. 1, the two components of the main embodiment are the high-strength magnets 3 and the silicon rubber encasement 1. One of the main considerations for this design is to have a soft body 1 that will not harm finished surfaces, such as automotive paint, powder coats, vinyl wraps, etc. Another consideration is to have cylindrical troughs 14 wide enough to accept a large variety of sockets 2, yet still have trough dividers 15 being tall enough to prevent aforementioned sockets 2 from constantly colliding. The force of the magnets 3 combined with the texture of the silicone rubber (or similar material) provides a strong hold on the sockets, which hold will be sufficient for the majority of tasks indicative of a typical automotive service shop environment.

Figure 2:
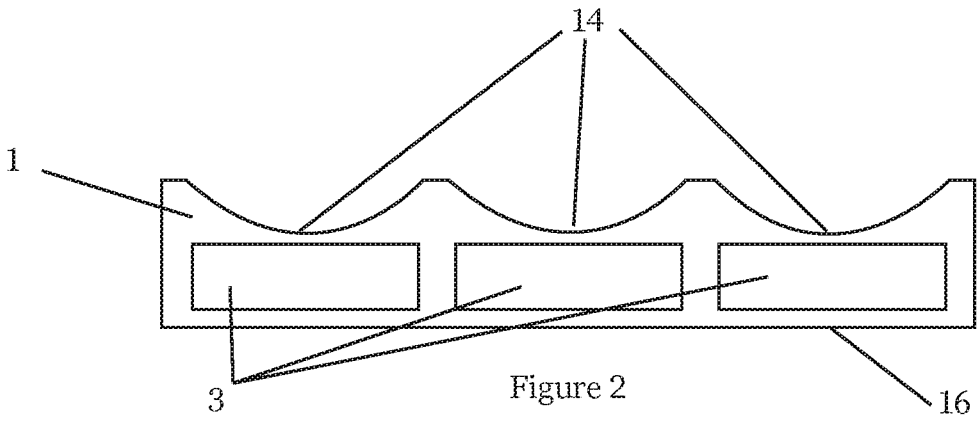
FIG. 2 shows a cross section of the main embodiment to illustrate the placement of the magnets.

In FIG. 2, the suspension of the magnets 3 within the rubber encasement 1 is being illustrated. Suspending the magnets 3 will require special manufacturing processes to ensure the magnet is far enough away from the surface to prevent damage of the surface to which it is affixed, yet close enough to the cylindrical troughs 14 and the underside 16 of the rubber encasement 1 to enable a strong hold.

Figure 3:
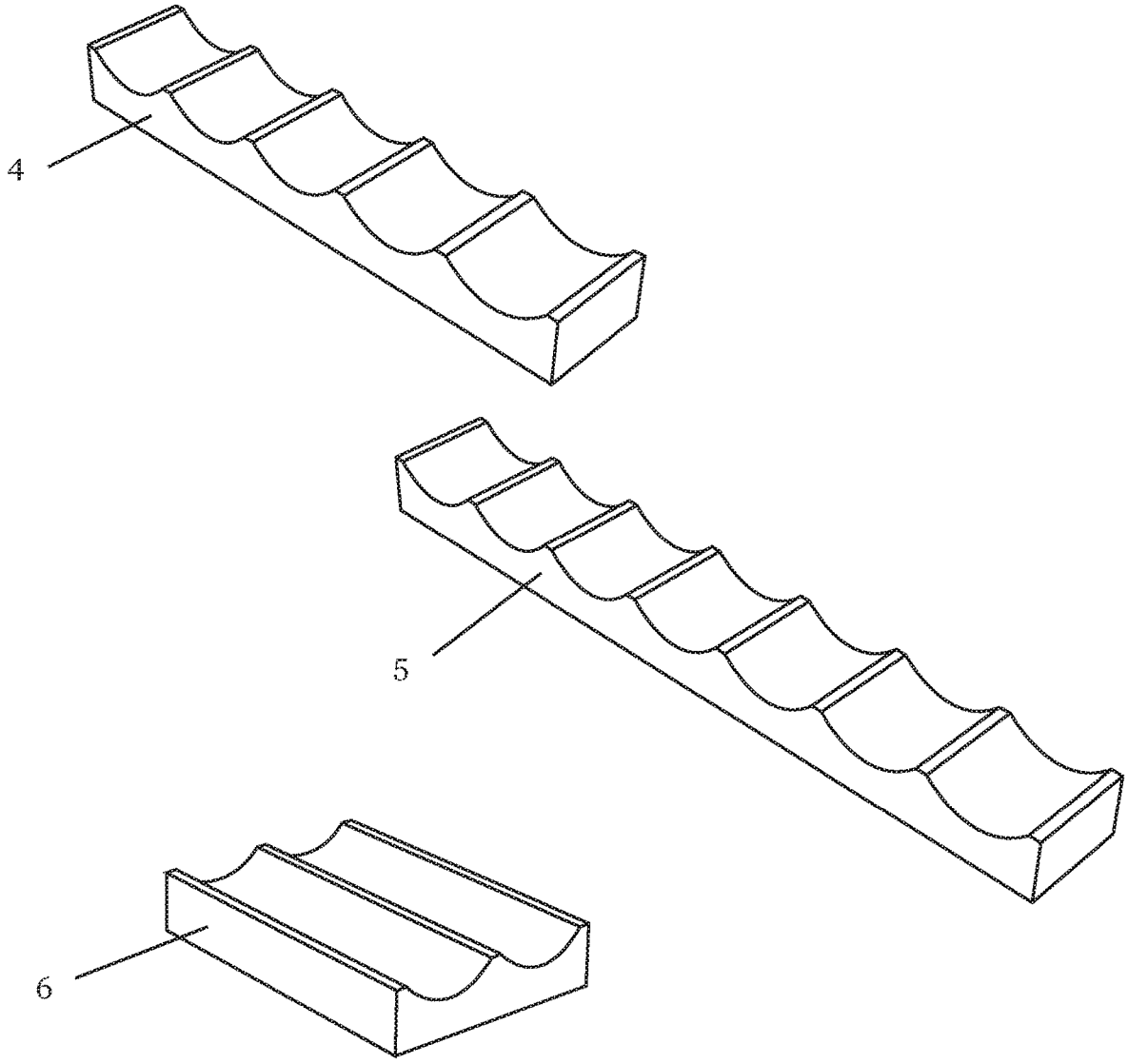
FIG. 3 shows three additional variations of the main embodiment wherein the number, length, and direction of troughs is varied.

FIG. 3 shows three additional variations of the main embodiment, including a five-socket variation 4, a seven-socket variation 5, and a two-socket variation 6. The total number of sockets intended to be held by any of the variations of this invention is a minimum of two and a maximum of nine.

Figure 4:
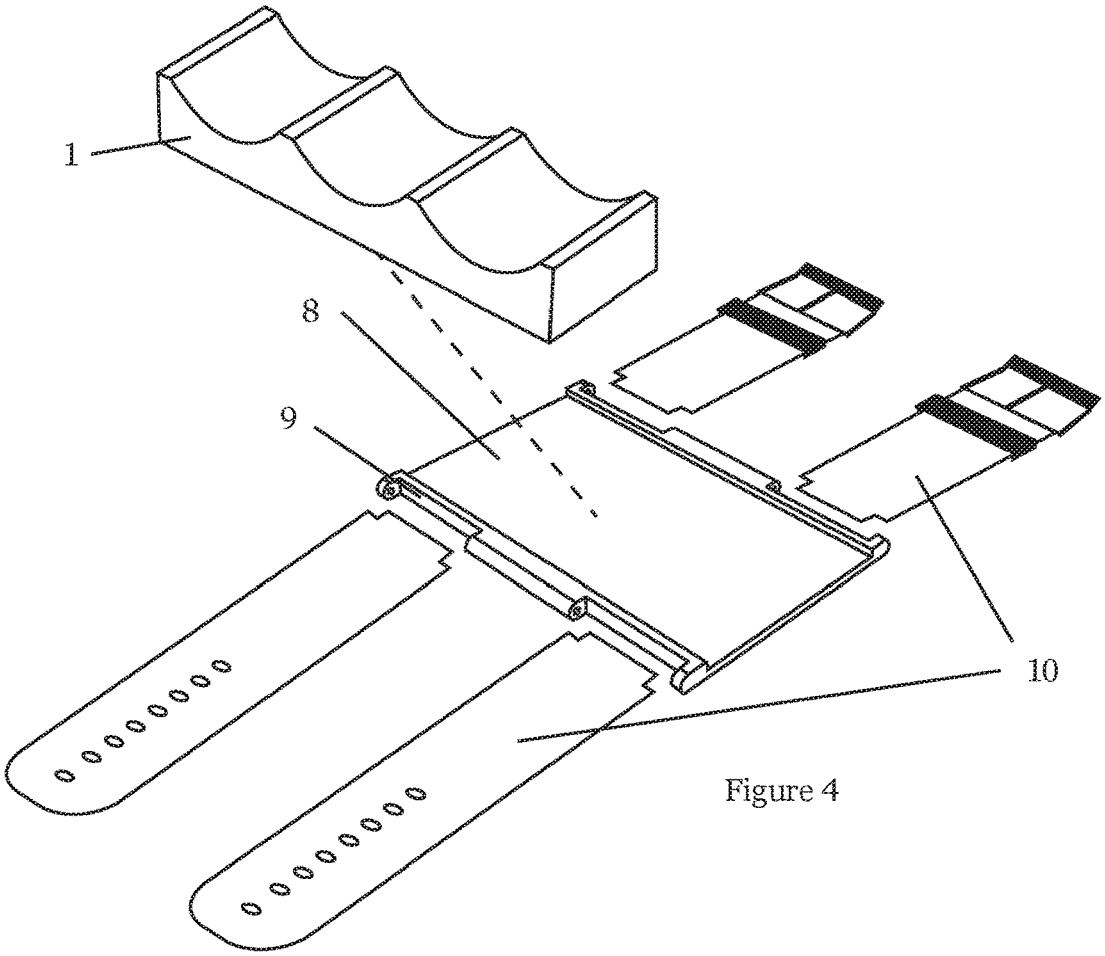
FIG. 4 shows a watch adapter accessory that can be used to attach the main embodiment to commonly available watch bands. The watch adapter is part of this specification, but the commonly available watch bands are not.

FIG. 4 is an illustration of one of the accessory inventions used to affix the main body 1 to a ferrous plate 8 machined with recesses 9 sized to receive commonly available watch straps 10. Being able to attach the invention to a user's wrist increases the portability and usefulness of the invention.

Figure 5:
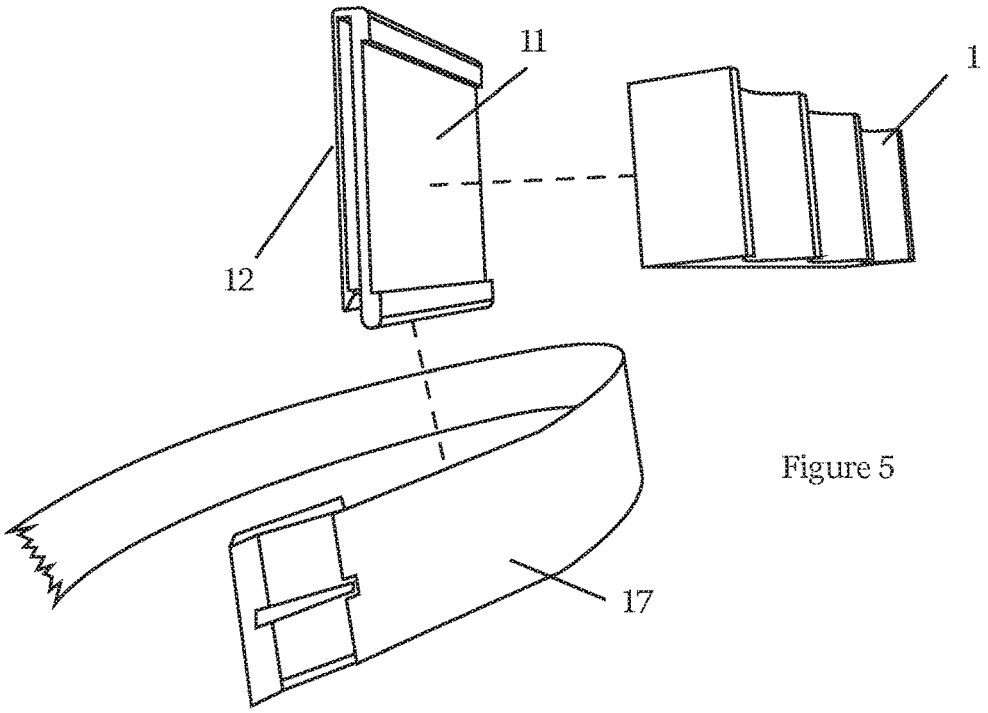
FIG. 5 shows a belt clip accessory that can be used to attach the main embodiment to commonly available belts. The belt clip is part of this specification, but the commonly available belts are not.

FIG. 5 is an illustration of another accessory invention used to affix the main body 1 to a ferrous plate 11 constructed with a clip 12 that can slip over a belt 17. This accessory increases the portability of the invention, while simultaneously keeping the user's forearms free from encumbrances if the user is working in a confined space.

Figure 6:
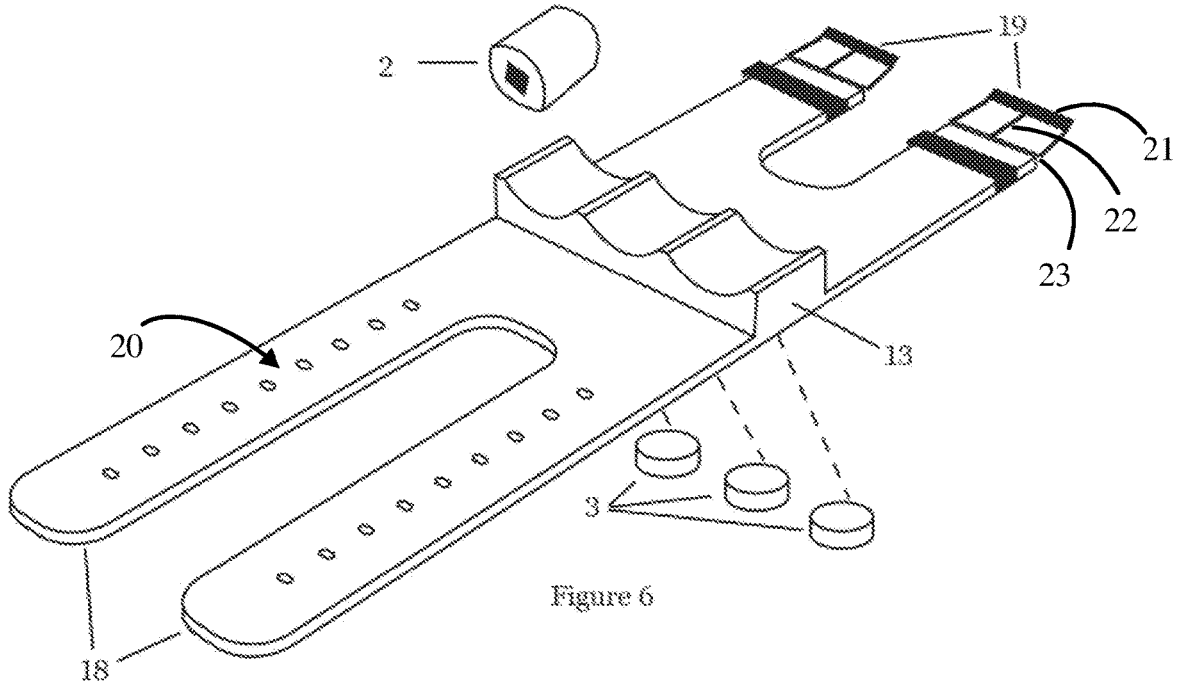
FIG. 6 shows an alternate embodiment of the invention, wherein the socket holder and the wrist straps are part of a single, unified silicon rubber (or similar material) body.
Figure 7:
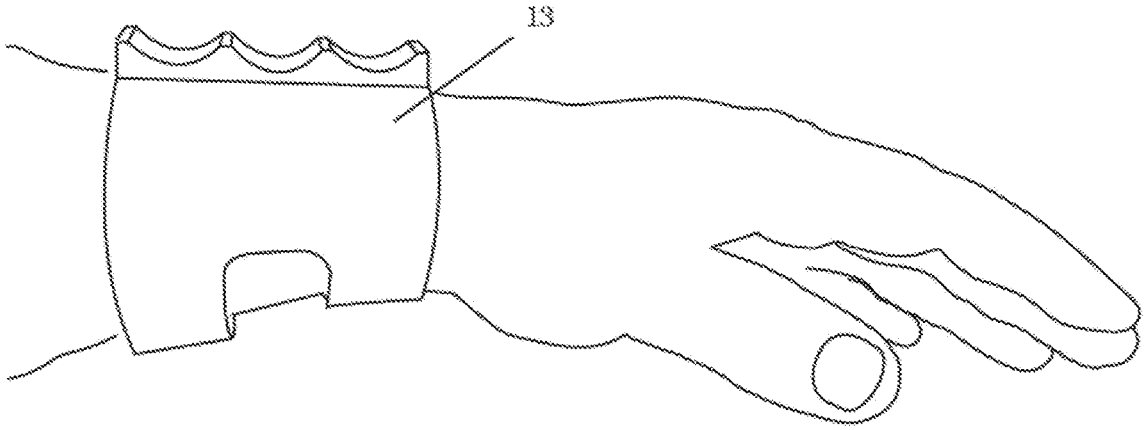
FIG. 7 shows how the alternate embodiment (depicted in FIG. 6) would be worn around the user's wrist.

FIG. 6 is a depiction of an alternate embodiment of the invention, wherein the silicone rubber (or other material) body 13 contains straps 18, each having a series of elliptical through holes 20, and buckles 19, each having a rectangular bracket 21 and rectangular bar 22 (in the middle of the bracket 21) attached to the corresponding strap 18 via a cylindrical shaft 23 to affix the invention to the user's wrist, as illustrated in FIG. 7.

The invention claimed is:

1. An apparatus to hold metal cylinders, the apparatus comprising:

a rubber body forming a flat face on a bottom side of the rubber body and defining a plurality of partial cylindrical recesses on an opposing side of the rubber body, each partial cylindrical recess having a consistent diameter and an axis traversing a width of the rubber body;

a plurality of magnets fully encased within the rubber body, wherein each magnet is disposed between the flat face and the opposite side of the rubber body to align with the axis of a corresponding partial cylindrical recess of the plurality of partial cylindrical recesses, with one of the poles of each magnet directed towards the flat face of the rubber body and the opposite pole of the magnet directed towards the opposite side of the rubber body.

2. The apparatus of claim 1, further comprising:

a rectangular plate constructed of ferrous material, wherein the plate has width and length larger than the width and length of the flat face to which the magnets are directed;

wherein the plate has two elongated extrusions running along parallel edges of the plate;

each of the elongated extrusions has two rectangular recesses no greater than 30 mm; and each of the inward facing faces formed by the rectangular recesses in the elongated extrusions contains a circular indention no greater than 2 mm in diameter and between 0.5 mm and 2 mm in depth.

3. The apparatus of claim 1, further comprising:

a rectangular plate constructed of ferrous material, wherein the plate has width and length larger than the width and length of the flat face mentioned in claim 1 to which the magnets are directed; and wherein the plate has a secondary plate running on a parallel plane and separated from the primary plate by a strip of the same material running along one edge.

4. The apparatus of claim 1, wherein:

the rubber body contains four strap extensions to the flat surface to which the magnets are directed;

two of the extensions run in exactly opposite directions of the other two extensions, and the bulk of the body containing the magnets and cylindrical recesses divides the opposing extensions;

one side of each of the opposing extensions contains a series of elliptical through holes spaced evenly along the entire length of the extension; and the opposite side of each extension bearing the through holes contains a rectangular bracket and rectangular bar in the middle of the bracket, both of which are affixed to the extension via a cylindrical shaft embedded in the extension and running perpendicular to the length of the extension.

* * * * *